United States Patent [19]

Kikel

[11] Patent Number: 4,848,197

[45] Date of Patent: Jul. 18, 1989

[54] MULTIPLE BIT HANDTOOL

[75] Inventor: Keith R. Kikel, Salt Lake City, Utah

[73] Assignee: Dean H. Wall, Sandy, Utah

[21] Appl. No.: 245,992

[22] Filed: Sep. 14, 1988

Related U.S. Application Data

[63] Continuation of Ser. No. 93,117, Sep. 1, 1987, abandoned, which is a continuation of Ser. No. 819,634, Jan. 17, 1986, abandoned.

[51] Int. Cl.[4] ..... B25B 23/00

[52] U.S. Cl. ..... 81/440; 81/438; 81/177.5; 81/177.6

[58] Field of Search .... 81/177.1, 177.4, 177.5–177.85, 81/124.1, 124.5, 125.1, 439, 440, 489, 490, 430

[56] References Cited

U.S. PATENT DOCUMENTS

| | | | |
|---|---|---|---|
| 187,600 | 2/1877 | Collins | 81/440 |
| 234,540 | 11/1880 | Collins | 81/177.6 X |
| 849,891 | 4/1907 | Ellingson | 81/177.6 X |
| 981,278 | 1/1911 | Jenks . | |
| 1,034,383 | 7/1912 | Bronson | 81/177.6 X |
| 2,804,970 | 9/1957 | Kuc | 81/440 |
| 2,836,210 | 5/1958 | Garofalo | 81/440 |
| 4,096,896 | 6/1978 | Engel | 81/177.85 |
| 4,512,693 | 4/1985 | Swanson | 81/440 |

FOREIGN PATENT DOCUMENTS

| | | | |
|---|---|---|---|
| 403769 | 1/1934 | United Kingdom | 81/439 |

*Primary Examiner*—James G. Smith

*Attorney, Agent, or Firm*—Jon C. Christiansen

[57] ABSTRACT

A multiple bit handtool having a first elongated barrel and a second elongated barrel rotatably attached to the first barrel. Bit-holding means on the ends of the barrels accept and hold bits. The second barrel may be rotated to a position perpendicular to the first barrel to provide greater torque.

19 Claims, 1 Drawing Sheet

MULTIPLE BIT HANDTOOL

This is a continuation application of application Ser. No. 093,117, filed Sept. 1, 1987, now abandoned, which is a continuation of application Ser. No. 819,634, filed Jan. 1, 1986, now abandoned.

BACKGROUND OF THE INVENTION

Many designs have been presented in the prior art for hand-held tools intended to accomplish a variety of purposes. Those purposes have included compounding torque, heavy-duty use, miniaturization, multiple applications and adaptability to carrying in a pocket or handbag.

To date, no single small hand tool design has provided the combination of compactness, high torque, ease of use and multiple bit capability. In most instances, prior art devices have been limited to multiple screwdriver sets, or wrench sets, or socketwrench sets, or the like, but only rarely to provide combinations of these.

It is, therefore, an objective of this invention to provide a hand tool offering compactness, high torque, ease of use and multiple bit capability.

This and other objectives, advantages and aspects of the invention are described in to the following description of the invention.

SUMMARY OF THE INVENTION

The tool of this invention has a first elongated barrel and a second elongated barrel rotatably attached to the first barrel. At least one end of each barrel has a bit-holding means. Each bit-holding means is adapted to accept and hold a bit. Preferably the first barrel includes an open portion adapted to receive one end of the second barrel. The second barrel can be rotated to a position substantially perpendicular to the first barrel to provide additional torque when using a bit positioned in the bit-holding means of the first barrel.

THE DRAWINGS

DETAILED DESCRIPTION OF PREFERRED EMBODIMENT

Figure 1:
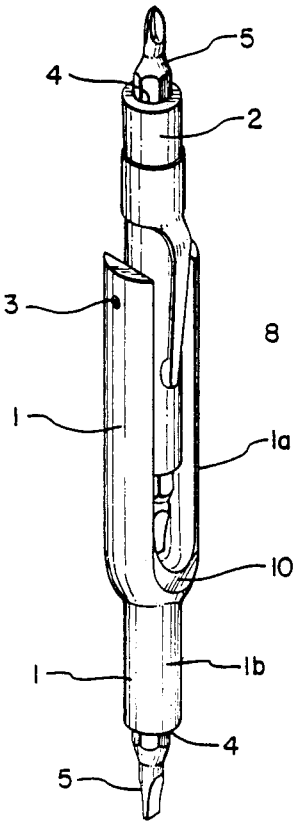
FIG. 1 depicts an embodiment of a multiple bit handtool with the second barrel in a straight position.
Figure 2:
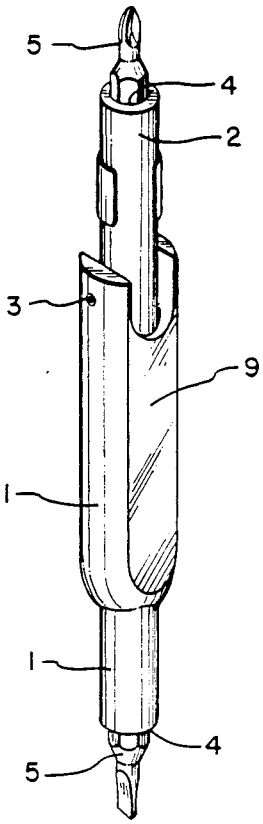
FIG. 2 depicts the multiple bit handtool of FIG. 1 rotated 180° about its vertical axis.
Figure 4:
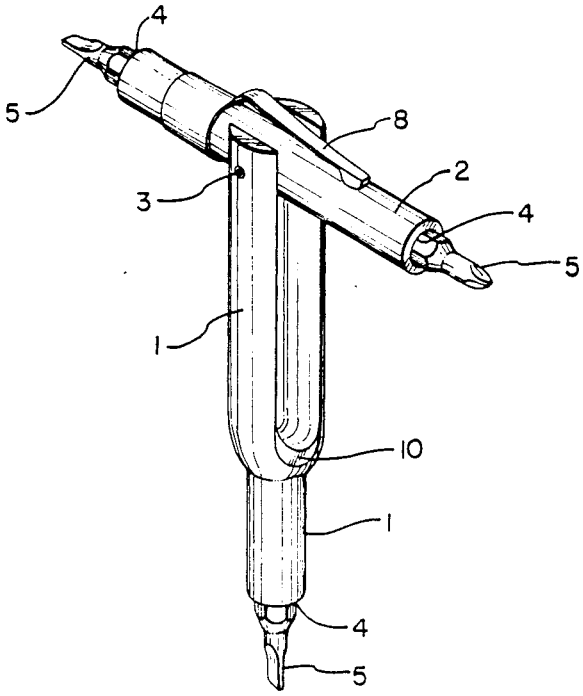
FIG. 4 depicts the multiple bit handtool with the second barrell in a perpendicular position.

The presently preferred embodiment of the multiple bit handtool is depicted in FIGS. 1,2 and 4. A first elongated barrel 1 is rotatably attached to a second elongated barrel 2. Pin 3 provides the means by which barrel 2 is attached to barrel 1. Pin 3 is in the middle of barrel 2. Barrel 2 rotates about pin 3. Although barrels 1 and 2 are substantially cylindrical (i.e. substantially circular cross-section) this is not a requirement of the invention. The elongated barrels may have rectangular, triangular, oval or other-shaped cross-sections. Furthermore, the cross-sectional size and shape of a barrel may be different for different portions of the barrel. For example, portion 1*a* of barrel 1 is different from portion 1*b* of barrel 1.

Figure 3:
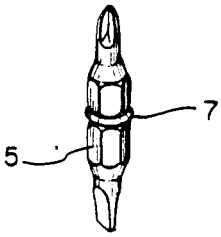
FIG. 3 depicts a double-headed bit.

Both ends of barrel 2 and one end of barrel 1 have bit-holding means 4. Each bit-holding means 4 is an opening on the end of the barrel. The opening has a hexagonal cross-section and is adapted to accept and hold bits 5. FIG. 3 depicts a double-headed bit 5 having a Phillips head and a flat head. The main body of bit 5 has a hexagonal cross-section for a friction fit into bit-holding means 4. A resilient ring 7 around bit 5 (see FIG. 3) improves the frictional fit of the bit into bit-holding means 4. Magnets, springs, spring balls and the like can also be used for bit-holding purposes. The invention is not limited to the bit-holding means shown in the drawings as any means capable of accepting and holding a bit on the end of a barrel can be used. For example, the bit-holding means can be a threaded cylindrical portion onto which a threaded (single-headed) bit is screwed. The exposed heads or ends of the bits can be covered with protective caps (not shown).

Double-headed bits are preferred because they give the user of the handtool a greater number of available tool options without the need for carrying extra bits. A double-headed bit can be removed from the bit-holding means, reversed and inserted back into the bit-holding means to make a different bit head available for use. There is no preferred selection of bits (as such preference is a matter of choice by the user) but one useful selection of double-headed screwdriver bits is comprised of the numbers 1, 2 and 3 Phillips heads paired respectively with the number 6 slotted, number 4 slotted and number 10 slotted flat-heads. The bits useful in this invention are not limited to screwdriver head bits and can include any other kind of bit or tool (for example, socket wrench heads, Allen wrench, butterfly, torque, star and other bit tips).

A portion 1a (see FIG. 1) of barrel 1 is open, hollow and adapted to receive an end of barrel 2. Barrel 2 can be rotated (for example from its FIG. 4 position) into (and nested in) the open area of portion 1a. Barrel 2 can also be rotated from its FIG. 1 position to a position perpendicular to barrel 1 as shown in FIG. 4. A tight fit allows barrel 2 to hold whichever position (including an intermediate position) it is given by the user of the tool.

When barrel 2 is in the open area of portion 1a of barrel 1, the handtool can be conveniently stored or carried about in a pocket as if it were a pen. A clip 8 is attached to barrel 2 (as shown in FIG. 1) to allow the user to clip the handtool onto a pocket sleeve.

When the handtool is in the perpendicular or "T" position of FIG. 4, it is capable of producing a great deal more torque than a normal screwdriver or socket set. It also will provide approximately two-thirds more turning radius than a standard screwdriver or socket set. This is because a standard screwdriver handle is twisted by the wrist and uses a limited number of muscles. The present invention, in contrast, uses more powerful body muscles especially in the back. Considering its greater turning radius, it can apply the increased torque for a longer period of time in each rotation.

In use, the handtool is functionally designed for barrel 2 to be placed across the palm of the hand with barrel 1 extending perpendicularly outwardly with two fingers on either side. An optional position has barrel 2 placed below the index finger. When high torque is not necessary, the handtool can be used in the "straight" position shown in FIGS. 1 and 2 and may be twisted with the fingers.

The handtool has been designed in this embodiment to include flat surface postions 9 and 10 on barrel 1 (see FIGS. 1 and 2) so as not to roll on inclined surfaces. The flat design also can accommodate the aid of a crescent or other wrench for additional torque within the strength limitations of the tool. The flat designe permits the use of a flat spring type belt clip that will snap on the tool and clip on the belt, similar to the pen clip.

The dimensions of the handtool can vary widely. The handtool (bits excluded) in the depicted embodiment is about 4 inches long in the FIG. 1 position. Barrel 1 is about 3 inches long and barrel 2 is about 2¼ inches long.

It is further understood that there are embodiments of this invention that will be obvious to one skilled in the art in view of the foregoing specification, and it is intended that these embodiments be included within the scope of this invention, which scope is limited only by the scope of the appended claims.

I claim:

1. A handtool having multiple bit capability comprising:

(a) a first elongated barrel having a bit-holding means on an end of said first elongated barrel, and (b) a second elongated barrel having a bit-holding means on at least one end of said second elongated barrel; wherein:

(i) said second barrel is rotatably attached at a fixed point to said first barrel and can be rotated about said fixed point to a position that is substantially perpendicular to said first barrel;

(ii) said bit-holding means are adapted to accept hold and release bits; and (iii) said second barrel is adapted to be hand-held and to provide for increased torque when said second barrel is perpendicular to said first barrel.

2. A handtool in accordance with claim 1 wherein said second barrel has on each of its ends a bit-holding means.

3. A handtool in accordance with claim 1 further comprising a clip means for securing said tool onto a pocket sleeve.

4. A handtool in accordance with claim 1 wherein said first barrel has an open portion adapted to receive one end of said second barrel; and wherein said end of said second barrel can be rotated into and received by said open portion.

5. A handtool in accordance with claim 4 wherein a pin positioned through said first barrel and said second barrel is used to attach said barrels; and wherein said second barrel can be rotated about said pin.

6. A handtool in accordance with claim 5 wherein said second barrel is rotatably attached by said pin to said first barrel at about the middle of said second barrel and at about an end of said first barrel; and wherein said end of said first barrel is the end opposite the end having said bit-holding means.

7. A handtool in accordance with claim 4 wherein said first barrel has a flat surface portion to prevent rolling on an inclined surface.

8. A handtool in accordance with claim 4 wherein said first barrel has a first flat surface portion and a second flat surface portion on said first barrel to prevent rolling on an inclined surface; wherein said first flat surface portion, and said second flat surface portion are on opposite sides of said first barrel.

9. A handtool in accordance with claim 1 wherein at least one of said barrels has a flat surface portion to prevent rolling on an inclined surface.

10. A handtool in accordance with claim 9 wherein said barrel with said flat surface portion also has a second flat surface portion on the opposite side of said barrel.

11. A handtool in accordance with claim 1 further comprising bits held in said bit-holding means.

12. A handtool in accordance with claim 5 wherein said bits are double-headed bits.

13. A handtool having multiple bit capability comprising:

(a) a first barrel having a bit-holding means on an end of said first barrel, and (b) a second barrel having a bit-holding means on each end of said second barrel; wherein:

(i) a portion of said first barrel is open, hollow and adapted to receive an end of said second barrel;

(ii) said second barrel is rotatably attached at a fixed point to said first barrel;

(iii) said second barrel can be rotated about said fixed point to a position that is substantially perpendicular to said first barrel;

(iv) an end of said second barrel can be rotated into and received by said open portion of said first barrel;

(v) each of said bit-holding means is adapted to accept hold and release bits; and (vi) said second barrel is adapted to be hand-held and to provide for increased torque when said second barrel is perpendicular to said first barrel.

14. A handtool in accordance with claim 3 wherein said second barrel is rotatably attached to said first barrel at about the middle of said second barrel.

15. A handtool in accordance with claim 14 further comprising bits held in said bit-holding means.

16. A handtool in accordance with claim 15 wherein said bits are double ended bits.

17. A handtool in accordance with claim 14 further comprising a clip attached to one of said barrels.

18. A handtool in accordance with claim 13 wherein said first barrel has a flat surface portion to prevent rolling on an inclined surface.

19. A handtool in accordance with claim 13 wherein a pin positioned through said first barrel and said second barrel is used to attach said barrels; and wherein said second barrel can be rotated about said pin.

* * * * *